US007199092B2

(12) United States Patent
Lu et al.

(10) Patent No.: US 7,199,092 B2
(45) Date of Patent: Apr. 3, 2007

(54) MULTI-PHASE LIQUID HARD SURFACE CLEANING AND/OR DISINFECTING COMPOSITIONS

(75) Inventors: Robert Zhong Lu, Montvale, NJ (US); Pamela White, Montvale, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 0 days.

(21) Appl. No.: 10/524,698

(22) PCT Filed: Aug. 7, 2003

(86) PCT No.: PCT/GB03/03466

§ 371 (c)(1),
(2), (4) Date: Feb. 16, 2005

(87) PCT Pub. No.: WO2004/018610

PCT Pub. Date: Mar. 4, 2004

(65) Prior Publication Data

US 2005/0256021 A1 Nov. 17, 2005

(30) Foreign Application Priority Data

Aug. 22, 2002 (GB) ..... 0219568.3

(51) Int. Cl.
*C11D 1/94* (2006.01)
*C11D 3/48* (2006.01)

(52) U.S. Cl. ..... 510/238; 510/199; 510/235; 510/237; 510/214; 510/362; 510/382; 510/384; 510/391; 510/421; 510/422; 510/490; 510/504

(58) Field of Classification Search ..... 510/199, 510/235, 237, 238, 214, 362, 382, 384, 391, 510/421, 422, 490, 504
See application file for complete search history.

(56) References Cited

U.S. PATENT DOCUMENTS

| | | | | |
|---|---|---|---|---|
| 3,929,678 A | | 12/1975 | Laughlin et al. | 252/526 |
| 4,348,292 A | * | 9/1982 | Ginn | 510/406 |
| 5,883,065 A | * | 3/1999 | Swift et al. | 510/321 |
| 6,180,587 B1 | * | 1/2001 | Fuller et al. | 510/417 |
| 6,440,924 B1 | * | 8/2002 | Jeschke et al. | 510/417 |
| 6,689,223 B1 | * | 2/2004 | Meine et al. | 134/2 |
| 6,720,300 B1 | * | 4/2004 | Endlein et al. | 510/417 |
| 6,797,685 B2 | * | 9/2004 | Zhu et al. | 510/417 |
| 2005/0039253 A1 | * | 2/2005 | Yang et al. | 4/631 |

FOREIGN PATENT DOCUMENTS

| | | | |
|---|---|---|---|
| EP | 116422 | | 8/1984 |
| EP | 175485 | | 3/1986 |
| GB | 1247189 | * | 9/1971 |
| GB | 2134916 | | 8/1999 |
| WO | WO 94/05757 | | 3/1994 |
| WO | WO 97/12019 | | 4/1997 |
| WO | 99/47635 | * | 9/1999 |
| WO | WO 99/47634 | | 9/1999 |
| WO | WO 99/47635 | | 9/1999 |
| WO | 00/24852 | * | 5/2000 |
| WO | WO 00/24852 | | 5/2000 |
| WO | WO 00/71665 | | 11/2000 |
| WO | WO 01/21752 | | 3/2001 |
| WO | WO 01/21753 | | 3/2001 |

OTHER PUBLICATIONS

International Search Report dated Nov. 12, 2003 for Application No. PCT/GB03/03466.
International Preliminary Examination Report dated Jun. 28, 2004 for Application No. PCT/GB03/03466.
Written Opinion dated Mar. 11, 2004 for Application No. PCT/GB03/03466.
Response to Written Opinion dated Jun. 10, 2004.
Combined Search and Examination Report from The Patent Office in Great Britain dated Mar. 6, 2003 for Application No. GB 0219568.3.

* cited by examiner

*Primary Examiner*—Charles Boyer
(74) *Attorney, Agent, or Firm*—Norris McLaughlin & Marcus PA

(57) ABSTRACT

Liquid cleaning and/or disinfecting composition which is separated into two phases at rest are combined and dispersed within each other upon shaking.

10 Claims, No Drawings

MULTI-PHASE LIQUID HARD SURFACE CLEANING AND/OR DISINFECTING COMPOSITIONS

The present invention relates to a liquid cleaning and/or disinfecting composition which is separated into two phases at rest where the phases are temporarily dispersed within each other upon shaking.

A recurring problem is that when cleaning hard surfaces, such as may be found in the kitchen or bathroom area, or win the cleaning of soft surfaces, such as textiles, as well as soiled garments and fabrics, is that both inorganic and organic stains and soils need to be treated and removed. Whereas surfactants and soaps are usually effective in removing organic stains and soils from such surfaces, they are usually less effective, or ineffective, in removing inorganic stains and soils. In order to remove inorganic stains and soils, including for example limescale, it is therefore necessary to use compounds, often in aqueous solution, which are suitable for dissolving or detaching this dirt. Depending on the nature of the dirt, these might be acid, neutral or alkaline compounds. In order to detach deposits of limescale, the buildup upon hard surfaces which is usually attributable to hardness-forming elements in water, it is preferred to use acid containing aqueous solutions. In order to remove other types of organic stains and soils, for example stains and soils containing clay and/or pigment, it is preferable to use aqueous solutions of ingredients which produce a pH value in the neutral or alkaline range in aqueous solution. In both cases, however, it has been found that the addition of surface-active agents to aqueous solutions used for removing inorganic stains and soils (if they are also required to remove organic stains and soils) can lead to a significant reduction in their effectiveness against inorganic stains and soils. Thus, providing an aqueous based composition effective against both inorganic stains and soils is not a trivial technical matter.

The prior art has proposed various compositions of the type to which this invention is generally related which are disclosed, inter alia, in WO099/47635, GB2134916, WO99/47634, WO00/24852, WO00/71665, WO01/21752, WO01/21753, GB1247189, EP116422 and EP175485. Notwithstanding the availability of such prior art compositions, they are not without shortcomings and thus remains a real and continuing need in the art for further improvements to multiphase compositions. The compositions of the present invention overcome many of the problems attendant upon prior art compositions.

The present inventors have discovered a liquid cleaning and/or disinfecting compositions which separates into at least at least two aqueous phases upon standing, which compositions include one or more components which have irritation mitigating properties which reduce the potential for ocular irritation. Herein, applicants have found new and inventive compositions which separate into at least two aqueous phases upon standing comprising:

(a) 0.01–10% wt. of at least one cationic surfactant having germicidal properties;

(b) 0.1–10% wt. of at least one nonionic surfactant;

(c) 0.1–10% wt. at least one component having irritation mitigating properties selected from the group consisting of amphoteric surfactant, anionic surfactant, and mixtures thereof;

(d) at least one electrolyte;

(e) optionally, one or more constituents for improving the aesthetic or functional features of the inventive compositions;

and the remainder to 100% wt. water.

The present inventors have surprisingly found that good cleaning and/or sanitization and/or disinfection and clear and stable phase separation into a plurality of liquid layers, even at elevated temperatures upon resting can be obtained with a low level amount of electrolyte while simultaneously providing a composition having a low eye irritation level.

In general, when left in a quiescent state, the inventive compositions separate into two (or more) distinct aqueous phases, each comprising a proportion of the total volume of the inventive compositions. Advantageously when the composition separates into two aqueous phases, namely an upper aqueous phase and a lower aqueous phase the respective volume ratios of the upper aqueous phase:lower aqueous phase is in the volume %/volume % varies from 20:80–80:20, preferably is in the range of 60:40–40:60, and most preferably is in the range of 45:55–55:45, and especially preferably is about 50:50. The respective volume ratios may be adjusted by controlling the amount of the first and second aqueous phases, but is most readily adjusted by controlling the amounts of the nonionic surfactant(s) and/or electrolyte(s) present in the inventive compositions.

Generally, the majority (in excess of 50% wt.) of the (a) at least one cationic surfactant having germicidal properties is found in the upper aqueous phase; the majority (in excess of 50% wt.) of (b) at least one nonionic surfactant is found in the upper aqueous phase; and the majority (in excess of 50% wt.) of the (c) at least one component having irritation mitigating properties selected from the group of amphoteric surfactant, anionic surfactant, and mixtures thereof, is found in the upper aqueous phase. The electrolyte(s) (in excess of 50% wt., preferably at least 75% wt.) is generally found the lower aqueous phase. When present, the dye can be selected so that the upper layer will have the color of the dye and the lower layer will not have color.

The inventive compositions include (a) at least one cationic surfactant having germicidal properties. Useful cationic surfactants having germicidal properties may be any one or more of those described in, for example, *McCutcheon's Detergents and Emulsifiers*, North American and International Editions, 2001; *Kirk-Othmer, Encyclopedia of Chemical Technology,* 4th Ed., Vol. 23, pp. 478–541, the contents of which are herein incorporated by reference.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

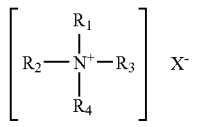

where at least one of $R_1$, $R_2$, $R_3$ and $R_4$ is an alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxy-alkyl, arylalkyl, etc. The remaining substituents on the nitrogen atoms other than the above mentioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pryridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Further particularly effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylphenyltrimethyl ammonium chloride, chlorinated dodecylbenzyltrimethyl ammonium chloride, and the like. Preferred quaternary ammonium compounds which act as germicides and which are found to be useful in the practice of the present invention include those which have the structural formula:

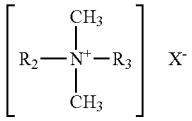

wherein $R_2$ and $R_3$ are the same or different $C_8$-$C_{12}$ alkyl, or $R_2$ is $C_{12-16}$ alkyl, $C_{8\ 18}$alkylethoxy, $C_{8-18}$alkylphenoxyethoxy and $R_3$ is benzyl, and X is a halide, for example chloride, bromide or iodide, or is a methosulfate or saccharinate anion. The alkyl groups recited in $R_2$ and $R_3$ may be straight-chained or branched, but are preferably substantially linear.

Exemplary useful quaternary germicides include compositions which include a single quaternary compound, as well as mixtures of two or more different quaternary compounds. Such useful quaternary compounds are available under the BARDAC®, BARQUAT®, HYAMINE®, CATIGENE, LONZABAC®, BTC®, and ONYXIDE® trademarks, which are more fully described in, for example, *McCutcheon's Functional Materials*, North American and International Editions, 2001, and the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in *McCutcheon's* as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT® 4280Z (each 80% active) are each described as alkyl dimethyl benzyl ammonium chloride/alkyl dimethyl ethyl benzyl ammonium chloride; and BARQUAT® MS-100 described as being a mixture of tetradecyl dimethyl benzyl ammonium chloride/dodecyl dimethyl benzyl ammonium chloride/hexadecyl dimethyl benzyl ammonium chloride (100% solid (powder)). Also, HYAMINE® 1622, described as diisobutyl phenoxy ethoxy ethyl dimethyl benzyl ammonium chloride (available either as 100% actives or as a 50% actives solution); HYAMINE® 3500 (50% actives), described as alkyl dimethyl benzyl ammonium chloride (also available as 80% active (HYAMINE® 3500–80); and HYAMINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% active); BTC® 776 is described to be myristalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125-80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). CATIGENE series is described as mixtures of alkyl dimethyl benzyl ammonium chlorides/alkyl dimethyl ethyl benzyl ammonium chlorides/dialkyl dimethyl ammonium chlorides. (BTC®, ONYXIDE®, and CATIGENE are presently commercially available from Stepan Company, Northfield, Ill. (CATIGENE from Stepan Europe)). Polymeric quaternary ammonium salts based on these monomeric structures are also considered desirable for the present invention. One example is POLYQUAT®, which is described as being a 2-butenyldimethyl ammonium chloride polymer.

In certain preferred embodiments of the invention, only one cationic surfactant having germicidal properties is included, while according to other preferred embodiments of the invention a plurality of cationic surfactants are necessarily included. When a plurality of cationic surfactants are present, advantageously they are a mixture of a dialkyl quaternary ammonium compounds (for example, when $R_1$ and $R_2$ are each from about $C_{10}$ to $C_{16}$ and $R_3$ and $R_4$ are each methyl; further examples are described above and are well known to those skilled in the art) and an alkyl benzyl quaternary ammonium compound (examples of which are described above and are well known to those skilled in the art) are present as the (a) at least one cationic surfactant having germicidal properties. In either instance, while stable compositions are formed with defined phase separation it has been found that using more than one cationic surfactant provides increased phase separation at room temperature and reduced phase shrinkage at elevated temperature, and compositions comprising a plurality of cationic surfactants is usually preferred over those comprising a single cationic surfactant.

The inventive compositions comprise 0.01–10% wt. of (a) at least one cationic surfactant having germicidal properties; desirably 0.5–4% wt., especially wherein the (a) at least one cationic surfactant is a mixture of cationic surfactants based on dialkyl quaternary ammonium compounds.

The inventive compositions also necessarily comprise (b) at least one nonionic surfactant, and virtually all known art nonionic surfactants may be used in the present inventive compositions. Illustrative examples of suitable nonionic surfactants for use as the (b) at least one nonionic surfactant include, inter alia, condensation products of alkylene oxide groups with an organic hydrophobic compound, such as an aliphatic compound or with an alkyl aromatic compound. The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent. Further, the length of the polyethenoxy hydrophobic and hydrophilic elements may be varied to adjust these properties. Illustrative examples of such a nonionic surfactants include the condensation product of one mole of an alkyl phenol having an alkyl group containing from 6 to 12 carbon atoms with from about 5 to 25 moles of an alkylene oxide. Another example of such a nonionic surfactant is the condensation product of one mole of an aliphatic alcohol which may be a primary, secondary or tertiary alcohol having from 6 to 18 carbon atoms with from 1 to about 10 moles of alkylene oxide. Preferred alkylene oxides are ethylene oxides or propylene oxides which may be present singly, or may be both present.

Still further illustrative examples of nonionic surfactants include primary and secondary linear and branched alcohol ethoxylates, such as those based on $C_6$–$C_{18}$ alcohols which further include an average of from 2 to 80 moles of ethoxylation per mol of alcohol. Examples include the Genapol® series of linear alcohol ethoxylates from Clariant Corp., Charlotte, N.C. The 26-L series is based on the formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1, 26-L-1.6, 26-L-2, 26-L-3, 26-L-5, 26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3, 24-L-45, 24-L-50, 24-L-60, 24-L-60N, 24-L-75, 24-L-92, and 24-L-98N. From product literature, the single number following the "L" corresponds to the average degree of ethoxylation (numbers between 1 and 5) and the two digit number following the letter "L" corresponds to the cloud point in ° C. of a 1.0 wt. % solution in water.

Further examples of useful nonionic surfactants include secondary $C_{12}$–$C_{15}$ alcohol ethoxylates, including those which have from about 3 to about 10 moles of ethoxylation. Such are available in the Tergitol® series of nonionic surfactants (Dow Chemical, Midland, Mich.), particularly those in the Tergitol® "15-S-" series. Further exemplary nonionic surfactants include linear primary $C_{11}$–$C_{15}$ alcohol ethoxylates, including those which have from about 3 to about 10 moles of ethoxylation. Such are available in the Tomadol® series of nonionic surfactants under the following tradenames: Tomadol 1-3 (linear $C_{11}$ alcohol with 3 moles (average) of ethylene oxide); Tomadol 1-5 (linear $C_{11}$ alcohol with 5 moles (average) of ethylene oxide); Tomadol 1-7 (linear $C_{11}$ alcohol with 7 moles (average) of ethylene oxide); Tomadol 1-9 (linear $C_{11}$ alcohol with 9 moles (average) of ethylene oxide); Tomadol 23–1 (linear $C_{12-13}$ alcohol with 1 mole (average) of ethylene oxide); Tomadol 23-3 (linear $C_{12-13}$ alcohol with 3 moles (average) of ethylene oxide); Tomadol 23-5 (linear $C_{12-13}$ alcohol with 5 moles (average) of ethylene oxide); Tomadol 23-6.5 (linear $C_{12-13}$ alcohol with 6.6 moles (average) of ethylene oxide); Tomadol 25-12 (linear $C_{12-15}$ alcohol with 11.9 moles (average) of ethylene oxide); Tomadol 25-3 (linear $C_{12-15}$ alcohol with 2.8 moles (average) of ethylene oxide); Tomadol 25-7 (linear $C_{12-15}$ alcohol with 7.3 moles (average) of ethylene oxide); Tomadol 25-9 (linear $C_{12-15}$ alcohol with 8.9 moles (average) of ethylene oxide); Tomadol 45-13 (linear $C_{14-15}$ alcohol with 12.9 moles (average) of ethylene oxide); Tomadol 45-2.25 (linear $C_{14-15}$ alcohol with 2.23 moles (average) of ethylene oxide); Tomadol 45-7 (linear $C_{14-15}$ alcohol with 7 moles (average) of ethylene oxide); Tomadol 91-2.5 (linear $C_{9-11}$ alcohol with 2.7 moles (average) of ethylene oxide); Tomadol 91-6 (linear $C_{9-11}$ alcohol with 6 moles (average) of ethylene oxide); Tomadol 91–8 (linear $C_{9-11}$ alcohol with 8.3 moles (average) of ethylene oxide) (Tomah Products, Inc., Milton, Wis.).

Further examples of useful nonionic surfactants include $C_6$–$C_{15}$ straight chain alcohols ethoxylated with about 1 to 13 moles of ethylene oxide, particularly those which include about 3 to about 6 moles of ethylene oxide. Examples of such nonionic surfactants include Alfonic® 810-4.5, which is described as having an average molecular weight of 356, an ethylene oxide content of about 4.85 moles and an HLB of about 12; Alfonic® 810-2, which is described as having an average molecular weight of 242, an ethylene oxide content of about 2.1 moles and an HLB of about 12; and Alfonic® 610-3.5, which is described as having an average molecular weight of 276, an ethylene oxide content of about 3.1 moles, and an HLB of 10.

Further examples of suitable nonionic surfactants for use as the (b) at least one nonionic surfactant include include alkyl glucosides, alkyl polyglucosides and mixtures thereof. Alkyl glucosides and alkyl polyglucosides can be broadly defined as condensation articles of long chain alcohols, e.g., $C_8$–$C_{30}$ alcohols, with sugars or starches or sugar or starch polymers i.e., glycosides or polyglycosides. These compounds can be represented by the formula $(S)_n$—O—R wherein S is a sugar moiety such as glucose, fructose, mannose, and galactose; n is an integer of from about 1 to about 1000, and R is a $C_{8-30}$ alkyl group. Examples of long chain alcohols from which the alkyl group can be derived include decyl alcohol, cetyl alcohol, stearyl alcohol, lauryl alcohol, myristyl alcohol, oleyl alcohol and the like. Commercially available examples of these surfactants include decyl polyglucoside (available as APG 325 CS from Henkel) and lauryl polyglucoside (available as APG 600 CS and 625 CS from Henkel).

A further class of nonionic surfactants which may find use in the present inventive compositions include ethoxylated octyl and nonyl phenols include those having one of the following general structural formulas:

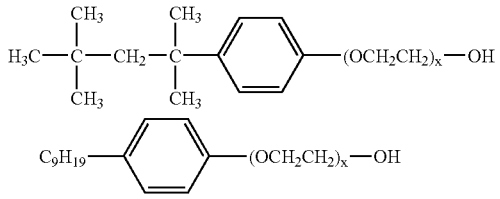

in which the $C_9H_{19}$ group in the latter formula is a mixture of branched chained isomers, and x indicates an average number of ethoxy units in the side chain. Particularly suitable non-ionic ethoxylated octyl and nonyl phenols include those having from about 7 to about 13 ethoxy groups. Such compounds are commercially available under the trade name Triton® X (Dow Chemical, Midland, Mich.), as well as under the tradename Igepal® (Rhodia, Princeton, N.J.). One exemplary and particularly preferred nonylphenol ethoxylate is Igepal® CO-630.

Still further examples of suitable nonionic surfactants for use as the (b) at least one nonionic surfactant include which may be advantageously included in the inventive compositions are alkoxy block copolymers, and in particular, compounds based on ethoxy/propoxy block copolymers. Polymeric alkylene oxide block copolymers include nonionic surfactants in which the major portion of the molecule is made up of block polymeric $C_2$–$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO—(EO)_x(PO)_y(EO)_z—H \quad (A)$$

where

EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants for use in the new compositions can be represented by the formula (B):

$$R—(EO,PO)_a(EO,PO)_b—H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000–5000.

Still further useful nonionic surfactants containing polymeric butoxy (BO) groups can be represented by formula (C) as follows:

$$RO—(BO)_n(EO)_x—H \quad (C)$$

wherein

R is an alkyl group containing 1 to 20 carbon atoms, n is about 5–15 and x is about 5–15.

Also useful as the nonionic block copolymer surfactants, which also include polymeric butoxy groups, are those which may be represented by the following formula (D):

$$HO—(EO)_x(BO)_n(EO)_y—H \quad (D)$$

wherein n is about 5–15, preferably about 15, x is about 5–15, preferably about 15, and y is about 5–15, preferably about 15.

Still further useful nonionic block copolymer surfactants include ethoxylated derivatives of propoxylated ethylene diamine, which may be represented by the following formula:

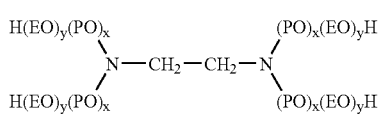

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

The inventive compositions most desirably nclude (b) at least one alcohol ethoxylated based nonionic surfactant in an amount of from 0.1–10% wt., but more preferably in an amount of from 0.2–4.0% wt. The present inventors have found that the amount, and type of nonionic surfactant(s) present in the inventive composition influences the volume of the upper aqueous phase with larger volumes being attained by increasing the amount of the nonionic surfactants present in the compositions. Especially preferred surfactant systems are described with reference to one or more of the Examples, below.

Various chemical compounds may be used as the (c) at least one component which may provide irritation mitigating properties selected from the group of amphoteric surfactant, anionic surfactant, and mixtures thereof. It is hypothesized that the presence of at least one amphoteric surfactant, or at least one anionic surfactant, or mixtures thereof function to mitigate the irritation potential of the compositions of which they form a part.

Amphoteric surfactants can be used as a component of (c) at least one component having irritation mitigating properties either with or without the anionic surfactant. Exemplary amphoteric surfactants include alkylampho(mono)acetates having the formula

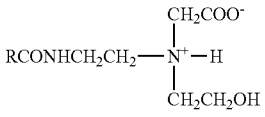

as well as one or more alkylampho(di)acetates according to the formula/ae

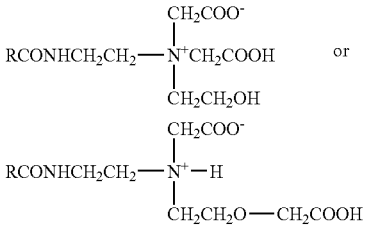

as well as alkylampho(mono)proprionates according to the formula

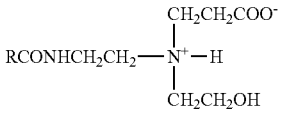

as well as one or more alkylampho(di)proprionates according to the formula/ae

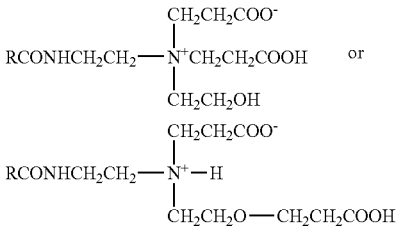

In the above formulae, R represents a $C_8$ to $C_{24}$ alkyl group, and is preferably a $C_{10}$ to $C_{16}$ alkyl group. Examples of these amphoteric surfactants can be found under the tradename Miranol from Rhodia (Cranbury, N.J.). Some examples include Miranol C2M-Conc. NP, described to be disodium cocoamphodiacetate; Miranol FA-NP, described to be sodium cocoamphotacetate; Miranol DM, described to be sodium steroamphoacetate; Miranol HMA, described to be sodium lauroamphoacetate; Miranol C2M, described to be cocoamphodiprioponic acid; Miranol C2M-SF, described to be disodium cocoamphodiproprionate; Miranol CM-SF Conc., described as being cocoamphopropriate; Mirataine H2C-HA, described as sodium lauiminodiproprionate; Miranol Ultra L-32, described as sodium lauroamphoacetate; and Miranol Ultra C-37, described as sodium cocoamphoacetate. Other amphoteric surfactants are also available under the tradename Amphoterge from Lonza (Fair Lawn, N.J.) such as Amphoterge K described to sodium cocoamphoproprionate; Amphoterge K-2, described as disodium cocoamphodiproprionate; Amphoterge W, described to be sodium cocoamphoacetate; and Amphoterge W-2, described to be disodium cocoamphodiacetate.

Anionic surfactants can be used as a component of (c) at least one component having irritation mitigating properties either with or without the amphoteric surfactant. Examples of anionic surfactants include alcohol sulfates and sulfonates, alcohol phosphates and phosphonates, alkyl ester sulfates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, alkyl ether sulfates, alpha-olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates or mixtures thereof.

Further examples of anionic surfactants include water soluble salts or acids of the formula $(ROSO_3)_xM$ or $(RSO_3)_xM$ wherein R is preferably a $C_6$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a mono-, di- or tri-valent cation, e. g., an alkali metal cation (e. g., sodium, potassium, lithium), or ammonium or substituted ammonium (e. g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like) and x is an integer, preferably 1 to 3, most preferably 1. Materials sold under the Hostapur and Biosoft trademarks are examples of such anionic surfactants.

Further examples of anionic surfactants include alkyl-diphenyl-ethersulphonates and alkyl-carboxylates. Other anionic surfactants can include salts (including, for example, sodium, potassium, ammonium, and substituted ammonium salts such as mono-, di-and triethanolamine salts) of soap, $C_6$–$C_{20}$ linear alkylbenzenesulfonates, $C_6$–$C_{22}$ primary or secondary alkanesulfonates, $C_6$–$C_{24}$ olefinsulfonates, sulfonated polycarboxylic acids prepared by sulfonation of the pyrolyzed product of alkaline earth metal citrates, e. g., as described in British patent specification No. 1,082,179, $C_6$–$C_{24}$ alkylpolyglycolethersulfates (containing up to 10 moles of ethylene oxide); alkyl ester sulfates such as $C_{14-16}$ methyl ester sulfates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12-C18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_k CH_2COO^-M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678 to Laughlin, et al. at column 23, line 58 through column 29, line 23, the contents of which are herein incorporated by reference.

The inventive compositions comprise (d) at least one electrolyte. The electrolyte(s) are typically alkali and alkali metal salts and include, for example, sodium chloride, sodium carbonate, sodium bicarbonate, sodium citrate, and the like. The amount of electrolyte can range from about 0.01 to about 5.0 wt %, preferably are present in amounts of from 0.05–5% wt., and most preferably are present in the amounts recited amongst the Examples. The quantity of the electrolyte present in the compositions functions to divide the compositions into at least two phases and it is to be understood that the effective amounts of the electrolyte will depend upon the specific electrolyte used and upon the identity and quantity of the other constituents present in the inventive compositions.

The inventive compositions optionally comprise (e) optionally, one or more constituents for improving the aesthetic or functional features of the inventive compositions. By way of non-limiting example such further constituents include one or more coloring agents, fragrances and fragrance solubilizers, viscosity modifying agents, other surfactants, pH adjusting agents and pH buffers including organic and inorganic salts, optical brighteners, opacifying agents, hydrotropes, antifoaming agents, enzymes, anti-spotting agents, anti-oxidants, preservatives, and anti-corrosion agents. When one or more of the optional constituents is added, i.e., fragrance and/or coloring agents, the esthetic and consumer appeal of the product is often favorably improved. The use and selection of these optional constituents is well known to those of ordinary skill in the art. When present, the one or more optional constituents present in the inventive compositions do not exceed about 10% wt., preferably do not exceed 5% wt.

Where the inventive compositions are to be used in conjunction wherein they are to be sprayed, particularly by use of manually operable trigger spray device, the inventors have found that the inclusion of one or more organic solvents may be beneficial. By way of non-limiting example exemplary useful organic solvents which may optionally be included in the inventive compositions include those which are at least partially water-miscible such as alcohols (e.g., low molecular weight alcohols, such as, for example, ethanol, propanol, isopropanol, and the like), glycols (such as, for example, ethylene glycol, propylene glycol, hexylene glycol, and the like), water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethylene glycol or propylene glycol (e.g. propylene glycol monomethyl ether acetate), and mixtures thereof. Glycol ethers having the general structure $R_a$—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Of course, mixtures of two or more organic solvents may be used in the organic solvent constituent.

The inventive compositions are largely aqueous in nature and the remaining balance of the compositions is water. Water is added to order to provide to 100% by weight of the compositions of the invention. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention.

The inventive compositions may be produced according to any of a number of methods. In general terms, the components can be added in any order although it may be preferred to add first the water, then the cationic and nonionic surfactant(s), then any dye and/or fragrance, and finally the electrolyte(s). Alternatively, components forming the upper layer can be mixed as one admixture and the components forming the lower layer can be mixed as another admixture and then the two admixtures can be added to one container to form the biphasic system. Thus, for example, a first premix can be made containing, for example, amphoteric surfactant, a majority of at least one cationic surfactant having germicidal properties, a majority of the nonionic surfactant, dye (if desired), fragrance (if desired), and water. A second premix can be made containing at least one electrolyte, a very minor portion of at least one cationic surfactant having germicidal properties, a very minor portion of nonionic surfactant, and water. Thereafter the first and second premixes may be combined to form the inventive compositions.

The compositions of the present invention can be used as a ready to use composition, supplied in a pour bottle or trigger bottle having a trigger pump spray device (in either use, a suitable container containing an amount of the two phase composition is first shaken to intermix the two layers and then the intermixed composition is then ready for use, either pouring on a surface and wiping, spraying on a surface and wiping, pouring on a wipe and then wiping a surface or spraying on a wipe and then wiping the surface) or can be supplied as a concentrate suitable for dilution in a larger container of water (after the concentrate is shaken to temporarily intermix the two layers). The compositions of the present invention will have good cleaning properties against dirt and stains commonly found in household, commercial and residential settings.

EXAMPLES

Various examples of the compositions of the present invention, including certain particularly preferred compositions are described below in Table 1. The individual constituents were used "as supplied" commercially, and identified by both tradename (as appropriate) and with the weigh percentage actives in the commercial preparation of the constituent in following parenthesis; no reported weight percentages are to understood as representing 100% wt. of the named constituent.

TABLE 1

| Components (% active) | Ex. 1 Wt % | Ex. 2 Wt % | Ex. 3 Wt % | Ex. 4 Wt % | Ex. 5 Wt % | Ex. 6 Wt % | Ex. 7 Wt % | Ex. 8 Wt % |
|---|---|---|---|---|---|---|---|---|
| Stepanate SXS (40%)[1] | 1.00 | 1.00 | 1.00 | 1.00 | 1.00 | 0.60 | 0.00 | 1.00 |
| BTC 8358 (80%)[2] | 2.00 | 2.00 | 2.00 | 2.00 | 2.00 | 1.50 | 1.50 | 2.00 |
| BTC 1010 (50%)[3] | — | — | — | — | 1.00 | — | — | 2.00 |
| Bardac 2250 (50%)[4] | — | — | — | 1.00 | — | 1.80 | 2.00 | — |
| Tomadol 45-7[5] | 2.00 | — | 1.50 | 1.50 | 1.50 | 1.50 | 1.50 | 1.20 |
| Alfonic 810-4.5[6] | — | 1.50 | — | — | — | — | — | — |
| NaCl[7] | 0.30 | 0.20 | — | 0.40 | 0.40 | 0.15 | 1.50 | 0.10 |
| Na Citrate[8] | — | — | 7.00 | — | — | 2.00 | — | — |
| $Na_2CO_3$[9] | 0.30 | 0.20 | — | 0.80 | 0.80 | — | 1.00 | 0.80 |
| $NaHCO_3$[10] | 1.80 | 1.00 | — | 0.30 | 0.30 | 1.50 | 1.00 | 0.80 |
| Dye (1% aqueous soln.) | 0.20 | 0.50 | 0.30 | 0.30 | 0.30 | 0.30 | 0.30 | 0.30 |
| Fragrance | 0.30 | 0.30 | 0.30 | 0.30 | 0.30 | 0.30 | 0.30 | 0.30 |
| DI Water | 92.10 | 93.30 | 87.90 | 92.40 | 92.40 | 90.35 | 90.90 | 91.50 |
| Separation starts (minutes) | ~20 | ~10 | 1–2 | 1–2 | 1–2 | 2–3 | ~8 | ~15 |
| Upper layer at RT | 80% | 30% | 40% | 40% | 30% | 40% | 52% | 60% |
| Upper layer at 120° F. overnight | --* | -- | 21% | 40% | 30% | 30% | 33% | 61% |

| Components (% active) | Ex. 9 Wt % | Ex. 10 Wt % | Ex. 11 Wt % | Ex. 12 Wt % | Ex. 13 Wt % | Ex. 14 Wt % | Ex. 15 Wt % | Ex. 16 Wt % |
|---|---|---|---|---|---|---|---|---|
| Miranol Ultra L-32 (32%)[11] | 1.50 | 2.00 | — | — | — | 2.20 | 2.20 | 2.00 |
| Miranol C2M NP (40%)[12] | — | — | 2.00 | 2.00 | 2.00 | — | — | |
| BTC 8358 (80%) | 2.00 | 0.50 | 0.80 | 0.50 | 0.52 | 0.65 | 0.60 | 0.50 |
| BTC 1010 (50%) | 2.00 | 2.40 | 2.00 | 2.40 | 2.40 | 2.40 | 2.40 | 2.40 |
| Tomadol 45-7 | 1.00 | — | 1.00 | — | — | — | — | |
| Genapol 26-L-50[13] | — | — | — | 0.40 | 1.20 | — | 1.20 | |
| Genapol 26-L-60[14] | — | 1.20 | — | 0.80 | — | 1.20 | — | |
| Genapol 26-L-80[15] | | | | | | | | 1.20 |
| NaCl | 0.80 | — | 0.10 | 0.26 | 0.26 | 0.25 | 0.19 | 0.20 |
| Na Citrate | — | 0.35 | — | — | — | — | — | |
| $Na_2CO_3$ | 1.20 | — | 1.00 | — | — | — | — | |
| $NaHCO_3$ | 1.20 | — | — | — | — | — | — | |
| Dye (1% aqueous soln.) | 0.30 | 0.30 | 0.30 | 0.28 | 0.28 | 0.28 | 0.28 | 0.28 |
| Fragrance | 0.30 | 0.30 | 0.30 | 0.30 | 0.30 | 0.30 | 0.30 | 0.30 |
| DI Water | 89.70 | 92.95 | 92.50 | 93.06 | 93.04 | 92.72 | 92.83 | 93.12 |
| Separation starts (minutes) | ~5 | ~5 | 1–2 | -- | 1–2 | 1–2 | 1–2 | -- |
| Upper layer at RT | 54% | 56% | 42% | 44% | 41% | 48% | 43% | 38% |
| Upper layer at 120° F. overnight | 39% | 26% | 26% | 35% | 35% | 42% | 40% | 36% |

| Components (% active) | Ex. 17 Wt % | Ex. 18 Wt % | Ex. 19 Wt % | Ex. 20 Wt % | Ex. 21 Wt % | Ex. 22 Wt % | Ex. 23 Wt % | Ex. 24 Wt % |
|---|---|---|---|---|---|---|---|---|
| Miranol Ultra L-32 (32%) | 1.76 | 1.76 | 1.60 | 1.00 | 1.00 | 1.00 | 0.80 | 2.00 |
| BTC 8358 (80%) | 0.48 | 0.48 | 0.43 | 0.40 | 0.40 | 0.40 | 0.40 | 0.50 |
| BTC 1010 (50%) | 1.92 | 1.92 | 1.73 | 1.80 | 2.00 | 2.20 | 2.10 | 2.40 |
| Genapol 26-L-50 | | | | | | | | 0.40 |
| Genapol 26-L-60 | — | 1.00 | — | — | — | — | — | |
| Genapol 26-L-80 | 1.00 | — | 1.00 | — | — | — | — | 0.80 |
| Unitol L/80[16] | — | — | — | 1.20 | 1.20 | 1.05 | 1.05 | |
| NaCl | 0.40 | 0.19 | 0.44 | 0.70 | 0.64 | 0.50 | 0.72 | 0.20 |
| Dye (1% aqueous soln.) | 0.20 | 0.20 | 0.20 | 0.08 | 0.23 | 0.23 | 0.23 | 0.28 |
| Fragrance | 0.28 | 0.28 | 0.28 | 0.28 | 0.28 | 0.28 | 0.28 | 0.30 |
| DI Water | 93.96 | 94.17 | 94.32 | 94.54 | 94.25 | 94.34 | 94.42 | 93.12 |
| Separation starts (minutes) | ~10 | ~10 | 15 | -- | -- | -- | -- | -- |
| Upper layer at RT | 38% | 44% | 37% | 48% | 46% | 43% | 38% | 43% |
| Upper layer at 120° F. overnight | 30% | 40% | 26% | 24% | 29% | 43% | 39% | 41% |

| Components (% active) | Ex. 25 Wt % | Ex. 26 Wt % | Ex. 27 Wt % | Ex. 28 Wt % | Ex. 29 Wt % | Ex. 30 Wt % |
|---|---|---|---|---|---|---|
| Miranol Ultra L-32 (32%) | 2.20 | 2.20 | 2.20 | 2.20 | 1.50 | 1.50 |
| BTC 8358 (80%) | 0.60 | 0.85 | 0.60 | 0.60 | 1.00 | 1.00 |
| BTC 1010 (50%) | 2.00 | 1.80 | 1.60 | 1.80 | 1.20 | 1.20 |
| Genapol 26-L-50 | 1.50 | 1.50 | 1.50 | 1.50 | -- | -- |
| Unitol L/80[16] | -- | -- | -- | -- | 1.00 | 1.00 |
| NaCl | 0.19 | 0.38 | 0.16 | 0.18 | 1.20 | 1.80 |
| Dye (1% aqueous soln.) | 0.28 | 0.28 | 0.28 | 0.28 | 0.22 | 0.16 |
| Fragrance | 0.30 | 0.30 | 0.30 | 0.30 | 0.28 | 0.28 |
| DI Water | 92.93 | 92.69 | 93.36 | 93.14 | 93.60 | 93.06 |
| Separation starts (minutes) | -- | -- | -- | -- | -- | -- |

TABLE 1-continued

| | | | | | | |
|---|---|---|---|---|---|---|
| Upper layer at RT | 49% | 51% | 49% | 48% | -- | 37% |
| Upper layer at 120° F. overnight | 30% | 29% | 27% | 29% | -- | 20% |

"RT" indicates room temperature, (approx. 68° F., 20° C.)
*-- indicates not evaluated, or not present in the formulation
[1]sodium xylene sulfonate (ex. Stepan)
[2]n-alkyl dimethyl benzyl ammonium chloride (n-alkyl: 50% $C_{14}$; 40% $C_{12}$; 10% $C_{16}$; (ex. Stepan)
[3]didecyl dimethyl ammonium chloride (ex. Stepan)
[4]didecyl dimethyl ammonium chloride (ex. Lonza)
[5]linear $C_{14-15}$ alcohol with 7 moles (average) of ethylene oxide (ex. Tomah)
[6]$C_8$–$C_{10}$ straight-chain alcohols ethoxylated with about 4.85 moles of ethylene oxide (ex. Sasol)
[7]sodium chloride
[8]sodium citrate
[9]sodium carbonate
[10]sodium bicarbonate
[11]sodium lauroamphoacetate (ex. Rhodia)
[12]disodium cocoamphodiacetate (ex. Rhodia)
[13]linear alcohol ethoxylate (ex. Clariant)
[14]linear alcohol ethoxylate (ex. Clariant)
[15]linear alcohol ethoxylate (ex. Clariant)
[16]ethoxylated lauryl alcohol (ex. Oxiteno)

Further examples of compositions of the present invention which are particularly suited for being dispensed in a ready to use form from a spray dispenser, such as a trigger spray container, including certain particularly preferred compositions are described below in Table 2. Further constituents present in the compositions according to Table 2, not previously described with reference to Table 1 are described following Table 2.

TABLE 2

| Components (% active) | Ex. 31 Wt % | Ex. 32 Wt % | Ex. 33 Wt % | Ex. 34 Wt % | Ex. 35 Wt % | Ex. 36 Wt % | Ex. 37 Wt % | Ex. 38 Wt % |
|---|---|---|---|---|---|---|---|---|
| Rhodapon BOS[17] (40%) | 0.84 | -- | 0.93 | 0.81 | 0.88 | 0.86 | 0.82 | -- |
| Hostapur SAS[18] (60%) | -- | 0.70 | -- | -- | -- | -- | -- | -- |
| Stepanate SXS[19] (40%) | 0.26 | 0.29 | -- | -- | -- | -- | -- | -- |
| Biosoft D40[20] (40%) | -- | -- | -- | -- | -- | -- | -- | 1.25 |
| BTC 8358 (80%) | 0.40 | 0.40 | 0.40 | 0.40 | 0.40 | 0.40 | 0.30 | 0.30 |
| BTC 1010 (50%) | 2.0 | 2.0 | 2.0 | 1.5 | 1.5 | 1.5 | 2.2 | 2.2 |
| Genapol 26-L-50 | 0.5 | 0.5 | 0.5 | 0.5 | 0.55 | 0.55 | 0.30 | 0.30 |
| Dowanol PnB[21] | -- | -- | 0.5 | 0.5 | -- | -- | -- | -- |
| Na citrate | 0.40 | 0.4 | 0.7 | 0.7 | 0.55 | 0.60 | 0.55 | 0.55 |
| citric acid | 1.5 | 1.5 | 1.8 | 2.0 | 1.8 | 1.8 | 1.8 | 1.8 |
| Dye (1%) | 0.25 | 0.25 | 0.25 | 0.25 | 0.25 | 0.25 | 0.25 | 0.25 |
| Fragrance | 0.22 | 0.22 | 0.22 | 0.22 | 0.22 | 0.22 | 0.28 | 0.28 |
| DI Water | 93.63 | 93.74 | 92.70 | 93.12 | 93.85 | 93.82 | 93.50 | 93.07 |
| Separation starts (minutes) | -- | -- | -- | -- | -- | 30 | -- | -- |
| Upper layer at RT | 37% | 45% | 55% | 49% | 84% | 64% | 38% | 40% |
| Upper layer at 120° F. overnight | 23% | 25% | -- | 22% | -- | 22% | 27% | -- |

| Components (% active) | Ex. 39 Wt % | Ex. 40 Wt % | Ex. 41 Wt % | Ex. 42 Wt % | Ex. 43 Wt % | Ex. 44 Wt % |
|---|---|---|---|---|---|---|
| Rhodapon BOS (40%) | 0.86 | 0.86 | 0.86 | 0.98 | -- | 0.85 |
| Hostapur SAS (60%) | -- | -- | -- | -- | -- | -- |
| Stepanate SXS (40%) | -- | -- | -- | -- | 1.0 | 0.26 |
| Biosoft D40 (40%) | -- | -- | -- | -- | 1.5 | -- |
| BTC 8358 (80%) | 0.3 | 0.3 | 0.4 | 0.4 | 0.4 | 0.4 |
| BTC 1010 (50%) | 2.2 | 2.2 | 1.5 | 2.0 | 2.0 | 2.0 |
| Genapol 26-L-50 | 0.3 | 0.3 | 0.4 | 0.4 | 0.4 | 0.4 |
| Dowanol PnB | -- | -- | -- | -- | -- | -- |
| Na citrate | 0.55 | 0.55 | 0.7 | 0.7 | 0.7 | 0.4 |
| citric acid | 1.8 | 1.8 | 2.2 | 1.8 | 1.8 | 1.8 |
| Dye (1% aqueous soln.) | 0.25 | 0.25 | 0.20 | 0.25 | 0.25 | 0.25 |
| Fragrance | 0.25 | 0.22 | 0.22 | 0.22 | 0.22 | 0.22 |
| DI Water | 93.49 | 93.52 | 93.42 | 93.15 | 91.63 | 93.32 |
| Separation starts (minutes) | -- | 20 | -- | 12 | -- | -- |

TABLE 2-continued

| | | | | | | |
|---|---|---|---|---|---|---|
| Upper layer at RT | 35% | 50% | 41% | 45% | 10% | 37% |
| Upper layer at 120° F. overnight | -- | -- | 18% | 20% | 10% | 23% |

17

[18]sodium alkane sulfonate
[19]sodium xylene sulfonate
[20]linear alkylbenzene sulfonate, sodium (Stepan)
[21]propylene glycol n-butyl ether (DOW)

Cleaning Efficacy

Certain of the compositions indicated above were diluted with water at a respective weight ratio of composition:water of 1:64. These diluted compositions were then subjected to the protocol of ASTM D-4488-89 Annex A5 for particulate soil, which evaluated the efficacy of the cleaning compositions on vinyl tile samples. The soil applied was a particulate soil sample containing natural humus, paraffin oil, used crankcase motor oil, Portland cement, silica, lampblack carbon, iron oxide, bandy black clay, stearic acid, and oleic acid produced according to the protocol. Each of the soiled test vinyl tile samples were placed into the apparatus and the center of each tile was wetted with a 20 milliliter sample of a test formulation and allowed to stand for 1 minute. When approximately 30 seconds had elapsed, a further 50 milliliter sample was applied to the sponge (water dampened, then wrung to remove excess water) of a Gardner Abrasion Tester apparatus. Thereafter the apparatus was cycled 10 times, which provided 20 strokes of the sponge across the face of each of the vinyl test tiles. Each test was replicated three times using three vinyl tile samples. The reflectance values of the cleaned samples were evaluated utilizing a Minolta Chroma Meter CF-110, with Data Processor DP-100, which evaluated spectrophotomic characteristics of the sample. The results are shown on the following Table.

| | Dilution | Soil Removal % | ±Δ % |
|---|---|---|---|
| Ex. 15 | 1:16 | 73.90 | 14.60 |
| Ex. 15 | 1:64 | 49.40 | 12.90 |
| PineSol | 1:64 | 57.71 | 8.33 |
| Mr Clean | 1:64 | 47.50 | 23.40 |

The composition according to Ex. 29 described on Table 1 was evaluated for cleaning efficacy of greasy soils in accordance with the testing protocol outlined according to ASTM D4488 A2 Test Method, which evaluated the efficacy of the cleaning compositions on masonite wallboard samples painted with wall paint. The soil applied was a greasy soil sample containing vegetable oil, food shortening and animal fat. The sponge (water dampened) of a Gardner Abrasion Tester apparatus was squirted with a 15 gram sample of a tested cleaning composition, and the apparatus was cycled 10 times. The evaluation of cleaning compositions was "paired" with one side of each of the test samples treated with a composition according to the invention, and the other side of the same sample treated with a comparative example's composition, thus allowing a "side-by-side" comparision to be made. The cleaning efficacy of the tested compositions was evaluated utililzing a Minolta Chroma Meter CF-110, with Data Processor DP-100, which evaluated spectrophotomic characteristics of the sample. The results are reported on the following Table. Each of the tested formulations on the following tables were evaluated without further dilution with water.

| | Dilution | Soil Removal % | ±Δ % |
|---|---|---|---|
| Ex. 29 | none | 73.96 | 1.20 |
| Practice 2 in 1 trigger spray (ex. Bom Bril (Brazil)) | none | 74.86 | 2.26 |
| Ex. 29 | none | 72.58 | 1.78 |
| Bref 2 in 1 trigger spray (ex. Henkel (Brazil)) | none | 71.14 | 2.07 |

Antimicrobial Efficacy

Certain of the compositions of the present invention exhibited good antimicrobial activity as evaluated using the AOAC Use Dilution Testing protocol.

TABLE 3

| | Organism | Results |
|---|---|---|
| Ex. 8 - dilution 1:64 | | |
| | *Staphylococcus aureus* | 0/10 |
| | *Salmonella* | 1/10 |
| | *Psuedomonas* | 0/10 |
| Ex. 9 - dilution 1:64 | | |
| | *Staphylococcus aureus* | 1/10 |
| | *Salmonella* | 0/10 |
| | *Psuedomonas* | 1/10 |
| Ex. 13 - dilution 1:16 | | |
| | *Staphylococcus aureus* | 0/10 |
| | *Salmonella* | 0/10 |
| | *Psuedomonas* | 1/10 |
| Ex. 14 - dilution 1:16 | | |
| | *Staphylococcus aureus* | 0/10 |
| | *Salmonella* | 0/10 |
| | *Psuedomonas* | 1/10 |
| Ex. 15 - dilution 1:16 | | |
| | *Staphylococcus aureus* | 0/10 |
| | *Salmonella* | 0/10 |
| | *Psuedomonas* | 2/10 |
| Ex. 25 - dilution 1:16 | | |
| | *Staphylococcus aureus* | 0/10 |
| | *Salmonella* | 0/10 |
| | *Psuedomonas* | 0/10 |
| Ex. 26 - dilution 1:16 | | |
| | *Staphylococcus aureus* | 0/9 |
| | *Salmonella* | 0/10 |
| | *Psuedomonas* | 0/10 |

TABLE 3-continued

| | Organism | Results |
|---|---|---|
| Ex. 27 - dilution 1:16 | | |
| | *Staphylococcus aureus* | 0/10 |
| | *Salmonella* | 0/10 |
| | *Psuedomonas* | 0/9 |
| Ex. 28 - dilution 1:16 | | |
| | *Staphylococcus aureus* | 0/10 |
| | *Salmonella* | 0/10 |
| | *Psuedomonas* | 0/9 |

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A hard surface treatment composition which separates into at least two aqueous phases, an upper aqueous phase and a lower aqueous phase upon standing comprising:

(a) 0.01–10% wt. of a mixture of cationic surfactants comprising at least one dialkyl quatenary ammonium compound and an alkylbenzyl quaternary ammonium compound wherein at least one cationic surfactant has germicidal properties;

(b) 0.1–10% wt. of at least one nonionic surfactant;

(c) 0.1–10% wt. at least one amphoteric surfactant selected from the group consisting of compounds having the formulas

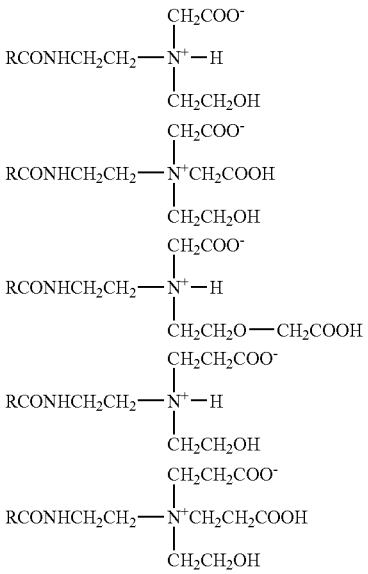

-continued

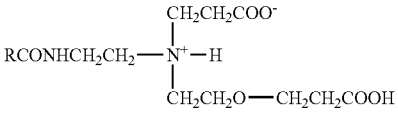

wherein R is $C_8$ to $C_{24}$ alkyl, and mixtures thereof;

(d) at least one electrolyte;

(e) optionally, one or more constituents for improving the aesthetic or functional features of the inventive compositions; and (f) the remaining balance to 100% wt., being water, wherein the volume ratio of the upper aqueous phase to the lower aqueous phase is between 20:80-80:20.

2. The composition according to claim 1 which exhibits antimicrobial efficacy against one or more organisms selected the group consisting of from: *Staphylococcus aureus, Salmonella*, and *Psuedomonas*.

3. The composition according to claim 2 which exhibits antimicrobial efficacy against one or more organisms selected the group consisting of from: *Staphylococcus aureus, Salmonella*, and *Psuedomonas* in an aqueous dilution of 1 part of the composition to 64 parts water.

4. The composition according to claim 2 which exhibits antimicrobial efficacy against one or more organisms selected from the group consisting of: *Staphylococcus aureus, Salmonella*, and *Psuedomonas* in an aqueous dilution of 1 part of the composition to 64 parts water.

5. The composition according to claim 1 wherein in excess of 50% wt. of the (a) mixture of cationic surfactants is found in the upper aqueous phase.

6. The composition according to claim 1 wherein the amount of (d) at least one electrolyte is present in an amount of from about 0.01 to about 5.0 wt %.

7. The composition according to claim 1 wherein (a) the mixture of cationic surfactants comprises two cationic surfactants having germicidal properties.

8. The composition according to claim 1 containing (e) at least one constituent for improving the aesthetic or functional features of the inventive compositions selected from the group consisting of coloring agents, fragrances and fragrance solubilizers, viscosity modifying agents, other surfactants, pH adjusting agents and pH buffers including organic and inorganic salts, optical brighteners, opacifying agents, hydrotropes, antifoaming agents, enzymes, anti-spotting agents, anti-oxidants, preservatives, and anti-corrosion agents.

9. The composition according to claim 1 wherein the volume ratio of the upper aqueous phase to the lower aqueous phase is between 45:55–55:45.

10. The composition according to claim 1 wherein the (c) at least one amphoteric surfactant present in the composition has irritation mitigating properties.

* * * * *

UNITED STATES PATENT AND TRADEMARK OFFICE

CERTIFICATE OF CORRECTION

PATENT NO. : 7,199,092 B2
APPLICATION NO. : 10/524698
DATED : April 3, 2007
INVENTOR(S) : Lu et al.

It is certified that error appears in the above-identified patent and that said Letters Patent is hereby corrected as shown below:

Column 19, Line 29, "one dialkyl quatenary ammonium compound" should read – "one dialkyl quaternary ammonium compound"

Signed and Sealed this

Twenty-fifth Day of November, 2008

JON W. DUDAS
*Director of the United States Patent and Trademark Office*